US011306374B2

(12) United States Patent
Choi et al.

(10) Patent No.: US 11,306,374 B2
(45) Date of Patent: Apr. 19, 2022

(54) HIGH-STRENGTH ALUMINUM ALLOY AND HIGH- STRENGTH ALUMINUM ALLOY CASTING

(71) Applicant: GAM CO., LTD., Hwaseong-si (KR)

(72) Inventors: Jin Yeol Choi, Suwon-si (KR); Byung-Cheol Lee, Suwon-si (KR)

(73) Assignee: GAM CO., LTD., Hwaseong-si (KR)

( * ) Notice: Subject to any disclaimer, the term of this patent is extended or adjusted under 35 U.S.C. 154(b) by 91 days.

(21) Appl. No.: 16/484,991

(22) PCT Filed: Feb. 14, 2018

(86) PCT No.: PCT/KR2018/001958

§ 371 (c)(1),
(2) Date: Aug. 9, 2019

(87) PCT Pub. No.: WO2018/151544

PCT Pub. Date: Aug. 23, 2018

(65) Prior Publication Data

US 2020/0056269 A1 Feb. 20, 2020

(30) Foreign Application Priority Data

Feb. 17, 2017 (KR) ..... 10-2017-0021815

(51) Int. Cl.

| | |
|---|---|
| ***C22C 21/14*** | (2006.01) |
| ***C22C 21/16*** | (2006.01) |
| ***C22C 21/18*** | (2006.01) |
| ***C22C 21/00*** | (2006.01) |
| ***C22C 21/02*** | (2006.01) |
| ***C22C 21/10*** | (2006.01) |

(52) U.S. Cl.

CPC ..... *C22C 21/14* (2013.01); *C22C 21/00* (2013.01); *C22C 21/02* (2013.01); *C22C 21/10* (2013.01); *C22C 21/16* (2013.01); *C22C 21/18* (2013.01)

(58) Field of Classification Search

None

See application file for complete search history.

(56) References Cited

U.S. PATENT DOCUMENTS

| | | | | | |
|---|---|---|---|---|---|
| 4,284,429 | A * | 8/1981 | Savas | C22C 21/02 148/417 |
| 4,973,363 | A | 11/1990 | Hayato et al. | |
| 5,846,347 | A * | 12/1998 | Tanaka | C22C 21/003 148/439 |
| 6,638,375 | B2 * | 10/2003 | Fujita | B32B 15/012 148/437 |
| 2005/0199318 | A1 | 9/2005 | Doty | |

FOREIGN PATENT DOCUMENTS

| | | | | |
|---|---|---|---|---|
| JP | 01-104742 | A | 4/1989 | |
| JP | 11-286758 | A | 10/1999 | |
| JP | 11325727 | A * | 11/1999 | |
| JP | 2001-020047 | A | 1/2001 | |
| JP | 2007-516344 | A | 6/2007 | |
| JP | 2015-157588 | A | 9/2015 | |
| KR | 10-1052517 | B1 | 7/2011 | |
| KR | 10-2012-0116101 | A | 10/2012 | |
| KR | 10-2015-0071796 | A | 6/2015 | |
| KR | 10-2015-0138937 | A | 12/2015 | |
| WO | WO-2017077137 | A2 * | 5/2017 | B22F 10/20 |

OTHER PUBLICATIONS

Endo et al., machine translation of JP 2015157588 Description, Sep. 3, 2015 (Year: 2015).*

Kinoshita Hiroshi, machine translation of JP H11-325727 Abstract and Description, Nov. 26, 1999 (Year: 1999).*

* cited by examiner

*Primary Examiner* — Mary I Omori

(74) *Attorney, Agent, or Firm* — Jae Youn Kim; Novick, Kim & Lee, PLLC

(57) ABSTRACT

Provided is a high-strength aluminum alloy including 2.0 to 13.0% by weight of copper (Cu), 0.4 to 4.0% by weight of manganese (Mn), 0.4 to 2.0% by weight of iron (Fe), 6.0 to 10.0% by weight of silicon (Si), greater than 0.0% by weight and 7.0 or less % by weight of zinc (Zn), greater than 0.0% by weight and 2.0 or less % by weight of magnesium (Mg), greater than 0.0% by weight and 1.0 or less % by weight of chromium (Cr), greater than 0.0% by weight and 3.0 or less % by weight of nickel (Ni), greater than 0.0% by weight and 0.05 or less % by weight of production-induced impurities, and the balance of aluminum (Al).

1 Claim, No Drawings

HIGH-STRENGTH ALUMINUM ALLOY AND HIGH- STRENGTH ALUMINUM ALLOY CASTING

TECHNICAL FIELD

The present invention relates to a high-strength aluminum alloy including 2.0 to 13.0% by weight of copper (Cu), 0.4 to 4.0% by weight of manganese (Mn), 0.4 to 2.0% by weight of iron (Fe), 6.0 to 10.0% by weight of silicon (Si), greater than 0.0% by weight and 7.0 or less % by weight of zinc (Zn), greater than 0.0% by weight and 2.0 or less % by weight of magnesium (Mg), greater than 0.0% by weight and 1.0 or less % by weight of chromium (Cr), greater than 0.0% by weight and 3.0 or less % by weight of nickel (Ni), greater than 0.0% by weight and 0.05 or less % by weight of production-induced impurities, and the balance of aluminum (Al).

BACKGROUND ART

In general, aluminum alloys are widely used as industrial materials in various fields such as automobiles, civil engineering, construction, shipbuilding, chemistry, aerospace, and food. Accordingly, it is necessary to develop an aluminum alloy with high mechanical strength.

Korean Patent No. 10-1052517 relates to an aluminum alloy casting that does not require heat treatment. However, the mechanical strength of such an aluminum alloy casting is not sufficient to support a large load.

Related Art Document

Korean Patent No. 10-1052517.

DISCLOSURE

Technical Problem

Therefore, the present invention has been made in view of the above problems, and it is one object of the present invention to provide a high-strength aluminum alloy including 2.0 to 13.0% by weight of copper (Cu), 0.4 to 4.0% by weight of manganese (Mn), 0.4 to 2.0% by weight of iron (Fe), 6.0 to 10.0% by weight of silicon (Si), greater than 0.0% by weight and 7.0 or less % by weight of zinc (Zn), greater than 0.0% by weight and 2.0 or less % by weight of magnesium (Mg), greater than 0.0% by weight and 1.0 or less % by weight of chromium (Cr), greater than 0.0% by weight and 3.0 or less % by weight of nickel (Ni), greater than 0.0% by weight and 0.05 or less % by weight of production-induced impurities, and the balance of aluminum (Al) so as to provide an aluminum alloy having increased strength.

Technical Solution

In accordance with an aspect of the present invention, the above and other objects can be accomplished by the provision of a high-strength aluminum alloy, including 2.0 to 13.0% by weight of copper (Cu), 0.4 to 4.0% by weight of manganese (Mn), 0.4 to 2.0% by weight of iron (Fe), 6.0 to 10.0% by weight of silicon (Si), greater than 0.0% by weight and 7.0 or less % by weight of zinc (Zn), greater than 0.0% by weight and 2.0 or less % by weight of magnesium (Mg), greater than 0.0% by weight and 1.0 or less % by weight of chromium (Cr), greater than 0.0% by weight and 3.0 or less % by weight of nickel (Ni), greater than 0.0% by weight and 0.05 or less % by weight of production-induced impurities, and the balance of aluminum (Al).

The high-strength aluminum alloy may further include one or more selected from the group consisting of greater than 0.0% by weight and 0.05 or less % by weight of lead (Pb), greater than 0.0% by weight and 0.05 or less % by weight of phosphorus (P), and greater than 0.0% by weight and 0.05 or less % by weight of carbon (C).

In accordance with another aspect of the present invention, there is provided a high-strength aluminum alloy casting manufactured by casting the high-strength aluminum alloy.

Advantageous Effects

As apparent from the above description, a high-strength aluminum alloy and a high-strength aluminum alloy casting according to the present invention exhibit excellent mechanical characteristics as shown in the following strength test results. In addition, the high-strength aluminum alloy and the high-strength aluminum alloy casting according to the present invention can be applied to casting (squeeze casting, roast wax casting, thixocasting, etc.) products such as a die casting, a gravity cast, and a low-pressure cast, or can be manufactured in a powder form to be applicable to the coating field or the 3D printing field.

BEST MODE

A high-strength aluminum alloy according to the present invention includes 2.0 to 13.0% by weight of copper (Cu), 0.4 to 4.0% by weight of manganese (Mn), 0.4 to 2.0% by weight of iron (Fe), 6.0 to 10.0% by weight of silicon (Si), greater than 0.0% by weight and 7.0 or less % by weight of zinc (Zn), greater than 0.0% by weight and 2.0 or less % by weight of magnesium (Mg), greater than 0.0% by weight and 1.0 or less % by weight of chromium (Cr), greater than 0.0% by weight and 3.0 or less % by weight of nickel (Ni), greater than 0.0% by weight and 0.05 or less % by weight of production-induced impurities, and the balance of aluminum (Al). In addition, the high-strength aluminum alloy according to the present invention may further include one or more selected from the group consisting of greater than 0.0% by weight and 0.05 or less % by weight of lead (Pb), greater than 0.0% by weight and 0.05 or less % by weight of phosphorus (P), and greater than 0.0% by weight and 0.05 or less % by weight of carbon (C).

Hereinafter, the characteristics and functions of elements included in the high-strength aluminum alloy according to the present invention are examined.

Copper (Cu) is partially dissolved in aluminum (Al) to exhibit solid-solution strengthening effect, and the remainder thereof is precipitated in the form of $Cu_2Al$ on a matrix.

Manganese (Mn) has solid-solution strengthening effect, fine precipitate effect, and ductility improvement effect.

Iron (Fe) has strength improvement effect.

Silicon (Si) contributes to increase the casting strength, and binds with aluminum Al) to increase strength.

Zinc (Zn) serves to refine crystal grains and, when applied in the form of $MgZn_2$, has strength increase effect. When zinc (Zn) is used in an amount of greater than 7%, strength may be decreased.

Magnesium (Mg) becomes a precipitate dispersed in the form of a fine metastable phase, $Mg_2Si$, thereby strengthening an alloy. When magnesium (Mg) is used in an amount of greater than 2%, it may react with other additives, thereby causing a decrease in elongation and strength.

Chromium (Cr) has strength improvement effect. However, when chromium (Cr) is used in an amount of greater than 1%, sludge may be formed due to peritectic precipitation.

Nickel (Ni) is present in the form of $NiAl_3$ and serves to increase the strength of an alloy. When the content of Ni is greater than 3%, ductility is decreased.

The high-strength aluminum alloy and the high-strength aluminum alloy casting according to the present invention can be applied to casting (squeeze casting, roast wax casting, thixocasting, etc.) products such as a die casting, a gravity cast, and a low-pressure cast, or can be manufactured in a powder form to be applicable to the coating field or the 3D printing field.

To evaluate the mechanical characteristics of the high-strength aluminum alloy according to the present invention, the following samples were prepared and the strength of each thereof was measured. Each element was weighted in an electronic balance, and then was fed into a graphite crucible, followed by dissolving using a high-frequency induction heater. As a result, an alloy was prepared. The prepared alloy was casted using a mold. The casted product was processed into a compressed specimen having a diameter X length of 3 mm×7.5 to 8 mm on a lathe. The processed specimen was subjected to a compression test at crossheading speed of 0.05 m/min by means of a universal tester to measure compression strength and elongation thereof.

In Table 1 below, componentsf each of high-strength aluminum alloys according to embodiments of the present invention are sun niarized in a unit of % by weight.

TABLE 1

| Sample No. | Cu | Mn | Fe | Si | Zn | Mg | Cr | Ni | Al |
|---|---|---|---|---|---|---|---|---|---|
| 01 | 8.6 | 3.7 | 1.0 | 7.8 | 0 | 0 | 0 | 1.0 | Remainder |
| 02 | 7.7 | 2.7 | 0 | 7.4 | 0 | 4.0 | 2.0 | 0 | Remainder |
| 03 | 9.0 | 1.9 | 1.0 | 6.8 | 0 | 0 | 0 | 4.0 | Remainder |
| 04 | 4.3 | 0.9 | 1.0 | 8.9 | 6.7 | 0 | 0 | 0 | Remainder |
| 05 | 2.2 | 0.5 | 0.5 | 8.5 | 6.8 | 1.7 | 0 | 0 | Remainder |
| 06 | 2.2 | 0.5 | 0.5 | 8.3 | 6.8 | 1.7 | 0.5 | 0 | Remainder |
| 07 | 4.3 | 1.9 | 1.9 | 7.8 | 6.6 | 1.7 | 0 | 0 | Remainder |
| 08 | 6.4 | 1.8 | 1.9 | 6.8 | 6.6 | 1.6 | 0 | 0 | Remainder |
| 09 | 8.5 | 1.8 | 1.0 | 6.2 | 6.5 | 1.6 | 0 | 0 | Remainder |
| 10 | 7.5 | 1.0 | 1.0 | 5.2 | 8.0 | 3.0 | 0 | 0 | Remainder |

In Table 2 below, compression strength and elongation measurement results of each of the high-strength aluminum alloys according to embodiments of the present invention are summarized.

TABLE 2

| Sample No. | compression strength (MPa) | Elongation (%) |
|---|---|---|
| 01 | 628 | 10.6 |
| 02 | 624 | 3.2 |
| 03 | 564 | 3.4 |
| 04 | 556 | 13.6 |
| 05 | 551 | 15.8 |
| 06 | 575 | 13.0 |
| 07 | 636 | 11.0 |
| 08 | 551 | 11.0 |
| 09 | 608 | 9.0 |
| 10 | 513 | 8.6 |

The high-strength aluminum alloys according to embodiments of the present invention were confirmed as having compression strength values of 551 MPa to 628 MPa and elongation rates of 9.0% to 15.8%. The embodiments of the present invention described above should not be understood as limiting the technical spirit of the present invention. The scope of the present invention is limited only by what is claimed in the claims and those of ordinary skill in the art of the present invention are capable of modifying the technical idea of the present invention in various forms. Accordingly, such improvements and modifications will fall within the scope of the present invention as long as it is obvious to those skilled in the art.

The invention claimed is:

1. A high-strength aluminum alloy, consisting of 4.3% by weight of copper (Cu), 1.9% by weight of manganese (Mn), 1.9% by weight of iron (Fe), 7.8% by weight of silicon (Si), 6.6% by weight of zinc (Zn), 1.7% by weight of magnesium (Mg), and a balance of aluminum (Al), wherein the high-strength aluminum alloy has a compressive strength value of 636 MPa and an elongation rate of 11.0%.

* * * * *